US005292377A

United States Patent [19]

Izeki et al.

[11] Patent Number: 5,292,377

[45] Date of Patent: Mar. 8, 1994

[54] FLUX SUITABLE FOR COATING MOLTEN ZINC, MOLTEN ALLOY OF ALUMINUM AND ZINC, AND MOLTEN ALUMINUM

[75] Inventors: Tatsumi Izeki, Mino; Yoshihiko Takano, Otsu; Koshi Takada, Higashiasai; Tetsuya Nakada, Suita, all of Japan

[73] Assignees: Tanaka Galvanizing Co., Ltd., Osaka; Sumitomo Metal Mining Co., Ltd., Tokyo, both of Japan

[21] Appl. No.: 928,168

[22] Filed: Aug. 13, 1992

Related U.S. Application Data

[63] Continuation of Ser. No. 798,790, Nov. 27, 1991, abandoned.

[30] Foreign Application Priority Data

Nov. 30, 1990 [JP] Japan ..... 2-339495

[51] Int. Cl.[5] ..... B23K 35/34

[52] U.S. Cl. ..... 148/23; 148/24; 148/25

[58] Field of Search ..... 148/23–25

[56] References Cited

U.S. PATENT DOCUMENTS

| | | | |
|---|---|---|---|
| 2,813,044 | 11/1957 | Chester | 117/51 |
| 3,030,241 | 4/1962 | Brightly, Jr. | 148/23 |
| 3,912,550 | 10/1975 | Bolte | 148/25 |
| 4,717,430 | 1/1988 | Beal | 148/26 |
| 4,802,932 | 2/1989 | Billiet | 148/26 |

*Primary Examiner*—Peter D. Rosenberg

*Attorney, Agent, or Firm*—Armstrong, Westerman, Hattori, McLeland & Naughton

[57] ABSTRACT

A flux for use in a dry process for the flux treatment of the material to be coated with molten metal contains at least one chloride selected from the group consisting of zinc chloride, stannous chloride, an alkali metal chloride and an alkaline earth metal chloride and at least one aliphatic nitrogen derivative with alkyl group having 1 to 18 carbons. The treatment of steel with this flux enables the formation of a coating having a good finish from, among others, a molten alloy of zinc and aluminum, which may further contain other elements, or molten aluminum, by a single dipping operation in an atmospheric environment which has hitherto been difficult. A process for manufacturing steel coated with molten metal, including its treatment with the flux, is also disclosed.

10 Claims, 2 Drawing Sheets

FLUX SUITABLE FOR COATING MOLTEN ZINC, MOLTEN ALLOY OF ALUMINUM AND ZINC, AND MOLTEN ALUMINUM

This application is a continuation of application Ser. No. 798,790 filed Nov. 27, 1991, and now abandoned.

FIELD OF THE INVENTION

This invention relates to a water-soluble flux which is used for the treatment of iron or steel to be coated with molten zinc, a molten alloy of zinc and aluminum, a molten alloy of zinc and aluminum further containing other elements, or molten aluminum.

BACKGROUND OF THE INVENTION

Building materials and structures made of iron or steel, including towers and bridges, are coated with molten zinc for protection against corrosion. The material to be coated is subjected to pretreatment by a process comprising the steps of degreasing, rinsing with water, pickling, rinsing with water, and flux treatment. The flux treatment of the steel to be coated is usually carried out by a dry process comprising dipping it in an aqueous flux solution, and drying it, though there is also a wet process.

It has hitherto been usual to employ as the flux an aqueous solution containing zinc chloride and ammonium chloride, or only ammonium chloride, as disclosed in Japanese Patent Application Laid-Open No. 136759/1983. Ammonium chloride is decomposed into hydrogen chloride and ammonia at a galvanizing temperature, and the ammonia combines with zinc chloride to form zinc monoaminechloride. The hydrogen chloride and zinc monoaminechloride are so corrosive as to remove from the surface of the steel to be coated the rust which has formed on the steel surface after its flux treatment, and the zinc oxide which the steel to be coated has drawn in from the surface of a zincbath when it has been dipped in it. Thus, they contribute to improving the wetting of the cleansed steel surface with molten zinc to enable the formation of a good zinc coating on the steel surface.

The recent development of an oceanic, or coastal region has given rise to the necessity for the construction or installation of road facilities, line hardware, and building structures in a highly corrosive environment. Various attempts have, therefore, been made to protect those facilities or structures by coating them with a galvanizing layer, or a thick layer of a paint, but none of them has been satisfactory. The problem of acid rain has added to the necessity for the effective rustproofing of steel structures. A snowy region has another problem. A snow melting agent, such as calcium chloride, causes the corrosion of steel. There are strict standards calling for the protection of steel sheets for automobiles against corrosion by a snow melting agent, as represented by a Canadian court decision.

A great deal of research work has, therefore, been made to obtain a coating giving a higher degree of corrosion resistance by electroplating or molten metal coating. A molten alloy of zinc and aluminum has, among others, drawn attention as being able to form a coating providing a high degree of corrosion resistance, and is already used to some extent or other for coating steel sheets. It is employed in a continuous coating process which is carried out in a non-oxidizing atmosphere.

There is also known a two-stage coating process which is employed for coating small parts, such as steel wire and line hardware, in an atmospheric environment. This process comprises coating the material with molten zinc, and coating it again immediately with a molten alloy of zinc and aluminum to form a coating of the alloy. The process, however, has a number of drawbacks including the necessity for the installation of a bath of the molten alloy of zinc and aluminum, the resulting increase in the space for installation and the cost of maintenance, and the operating time prolonged by the repeated coating operation.

There is hardly known any case where a single-stage coating process employing a molten alloy of zinc and aluminum has been carried out in an atmospheric environment, though hot dip galvanizing has always been done in such an environment. This means that it has been impossible to obtain a satisfactory coating of an alloy of zinc and aluminum even by using the flux as disclosed in Japanese Patent Application Laid-Open No. 136759/1983, if the process is carried out in an atmospheric environment.

The inability of any single-stage process to form a satisfactory coating from a molten alloy of zinc and aluminum in an atmospheric environment is due to the selective oxidation of aluminum which occurs in the surface of the zinc bath and prevents any satisfactory contact between the steel to be coated and the constituents of the bath, and also to the fact that the zinc chloride and ammonium chloride which are used as the flux in ordinary hot dip galvanizing coating undergo the following reactions:

$$3ZnCl_2+2Al \rightarrow 3Zn+2AlCl_3$$

$$6NH_4Cl+2Al \rightarrow 2AlCl_3+6NH_4+3H_2$$

These reactions lower the effect of the flux and result in an unsatisfactory coating having bare spots, roughness, or lumpiness.

Although it has been known that the use of a zinc both containing aluminum at a high concentration yields a coating of improved corrosion resistance, the absence of any appropriate flux has made it difficult to form any satisfactory coating on an industrial basis.

SUMMARY OF THE INVENTION

Under these circumstances, it is an object of this invention to provide a flux which can be used in a dry process for the flux treatment of steel to permit a coating having a good finish to be formed on the steel from molten metal, including a molten alloy of zinc and aluminum, a molten alloy of zinc and aluminum further containing other elements, and molten aluminum, by a single-stage coating process carried out in an atmospheric environment.

This object is attained by a flux comprising at least one chloride selected from the group consisting of zinc chloride, stannous chloride, an alkali metal chloride and an alkaline earth metal chloride and at least one aliphatic nitrogen derivative with alkyl group having 1 to 18 carbons.

An alkyl quaternary ammonium salt with alkyl group having 7 to 18 carbons, or an alkylamine with alkyl group having 1 to 18 carbons, or both are preferably used as the aliphatic nitrogen derivative, or derivatives. The preferred alkyl quaternary ammonium salts are alkyltrimethylammonium chloride and dialkyldimethylammonium chloride.

The flux preferably comprises 10 to 50% by weight of at least one of zinc chloride and stannous chloride, 1 to 20% by weight of at least one of alkali metal chloride and alkaline earth metal chloride, and 0.1 to 30% by weight of at least one of alkyl quaternary ammonium salts and alkylamines.

It is another object of this invention to provide a process for manufacturing steel coated with molten metal, including its treatment with the flux of this invention.

This object is attained by a process comprising the steps of pretreating the steel to be coated by dipping it in an alkali bath to degrease it, rinsing it with water, and pickling it; treating the steel by dipping with a flux containing at least one chloride selected from the group consisting of zinc chloride, stannous chloride, alkali metal chloride and alkaline earth metal chloride, and at least one aliphatic nitrogen derivative with alkyl group having 1 to 18 carbons: dipping the steel in a bath of molten metal to form a coating on it; and cooling the steel by dipping it in water, or by exposing it to air.

The flux of this invention is particularly effective for the treatment of the material to be coated with molten zinc, a molten alloy of zinc and aluminum, a molten alloy of zinc and aluminum further containing other elements, or molten aluminum.

Referring to the individual constituents of the flux, zinc chloride or stannous chloride dissolves the oxide which remains as a thin layer on the surface of the steel to be coated, and the oxide which forms a film on the surface of a molten bath. If the proportion of the chloride is less than 10% by weight, the flux does not have a satisfactory power of dissolving the oxides. If it excees 50% by weight, the flux undergoes crystallization at a low temperature and is also too viscous to use easily.

The alkali metal chloride, or alkaline earth metal chloride maintains the flux in a solution having an appropriate degree of viscosity at a coating temperature. If the proportion of the salt is less than 1% by weight, the flux is too low in viscosity to adhere satisfactorily to the material to be coated. If it exceeds 20% by weight, the flux is so high in viscosity that an undesirably large amount of flux adheres to the material to be coated.

The aliphatic nitrogen derivative bubbles on the surface of the steel dipped in a molten bath and removes the waste of the flux from the steel surface to improve the wetting of the steel surface with the molten metal. A particularly strong action is exhibited by an alkyl quaternary ammonium salt, or alkylamine which bubbles as a result of Hofmann decomposition. If the proportion of the derivative is less than 0.1% by weight, the flux fails to exhibit any such action. If it exceeds 30% by weight, the flux is too expensive, and what is worse, it leaves bare spots on the steel dipped in a molten bath.

As above described, the flux of this invention is not only suitable for the treatment of the material to be coated with a molten alloy of zinc and aluminum, a molten alloy of zinc and aluminum further containing other elements or molten aluminum, but also it can be used for ordinary hot dip galvanizing.

The treatment of steel with the flux of this invention after its degreasing, rinsing with water, and pickling, enables a good coating to be formed on the steel surface by a single-stage dip-coating process where the steel to be coated is dipped directly in a molten alloy of zinc and aluminum, a molten alloy of zinc and aluminum further containing other elements or molten aluminum. Of course a single-stage dip-coating process can be employed in an ordinary hot dip galvanizing.

DETAILED DESCRIPTION OF THE INVENTION

Figure 1:
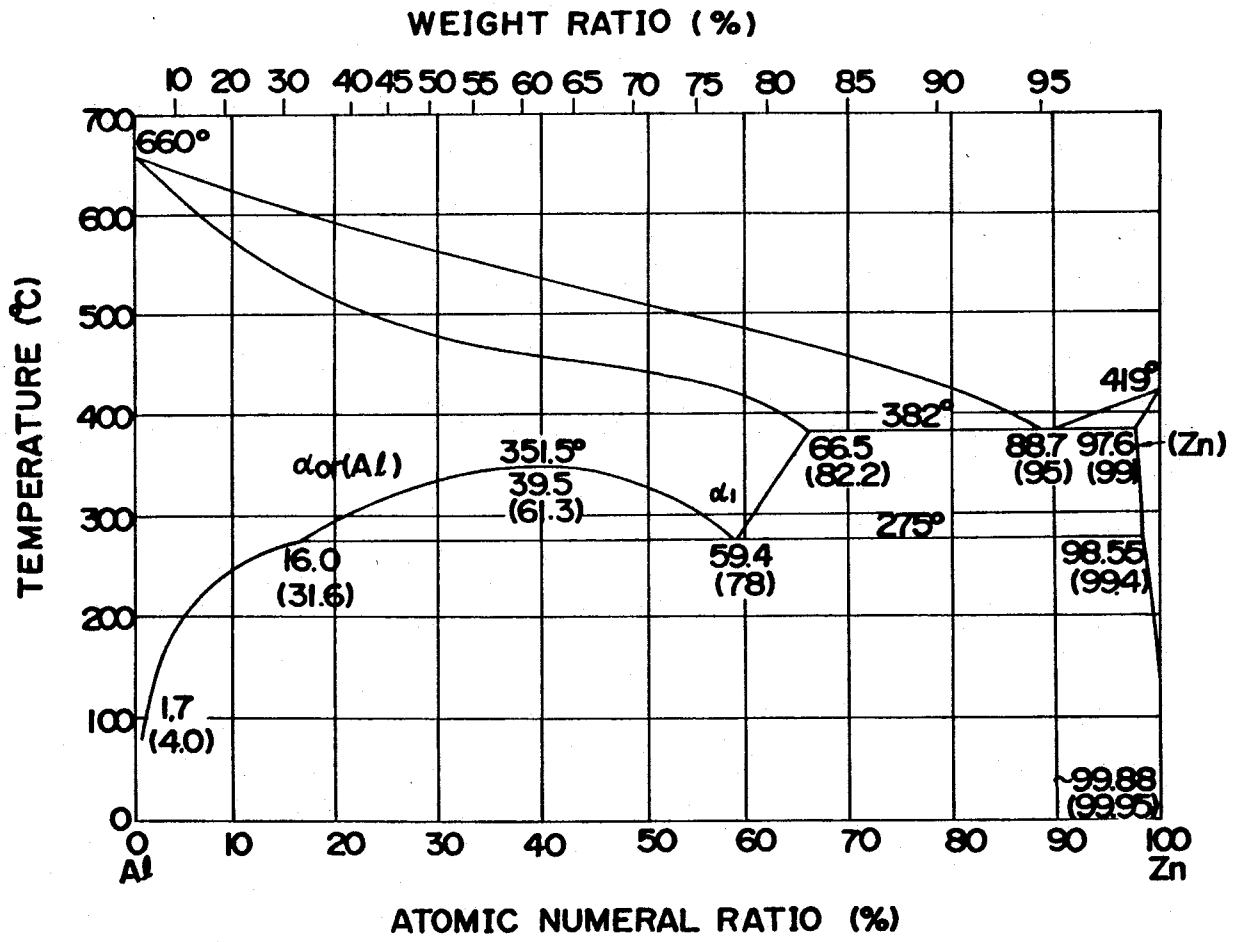
FIG. 1 is a phase diagram of an alloy of zinc and aluminum.

The flux of this invention essentially comprises at least one chloride selected from the group consisting of zinc chloride, stannous chloride, an alkali metal chloride and an alkaline earth metal chloride and at least one aliphatic nitrogen derivative with alkyl group having 1 to 18 carbons.

The alkali metal chloride may be the chloride, such as lithium, sodium or potassium. The alkaline earth metal chloride may be the chloride, such as beryllium, magnesium, calcium, strontium or barium.

The aliphatic nitrogen derivative with alkyl group having 1 to 18 carbons may be an alkyl quaternary ammonium salt with alkyl group having 7 to 18 carbons, or an alkylamine with alkyl group having 1 to 18 carbons. The former is preferred. Preferred examples of the alkyl quaternary ammonium salts are alkyltrimethylammonium chloride and dialkyldimethylammonium chloride. Examples of the alkyl groups which they may contain are octyl, decyl, dodecyl, tetradecyl, hexadecyl, octadecyl, octadecenyl, and octadecenyl.

Examples of the alkylamines which can be employed are an aliphatic primary amine such as methylamine or ethylamine, an aliphatic secondary amine such as dimethylamine or diethylamine, and an aliphatic tertiary amine such as trimethylamine or triethylamine.

The flux preferably comprises 10 to 50% by weight of zinc chloride and/or stannous chloride, 1 to 20% by weight of at least one alkali metal chloride or alkaline earth metal chloride and 0.1 to 30% by weight of at least one alkyl quaternary ammonium salt, or alkylamine.

More preferably, it comprises 30 to 40% by weight of zinc chloride or stannous chloride, or both, 5 to 10% by weight of at least one alkali metal chloride or alkaline earth metal chloride, and 1 to 10% by weight of at least one alkyl quaternary ammonium salt, or alkylamine. The flux preferably containes, for example, $ZnCl_2$, and NaCl in a molar ratio of 4:1 and $ZnCl_2$ and $CaCl_2$ in a molar ratio of 3:1 if it is used for the treatment of the material to be coated in a bath having a temperature of 400° C. to 600° C., and $ZnCl_2$ and NaCl in a molar ratio of 3:1 and $ZnCl_2$ and $CaCl_2$ in a molar ratio of 2:1 if it is used for the treatment of the material to be coated in a bath having a temperature of 600° C. to 700° C.

The process of this invention comprises the steps of pretreating the steel to be coated, treating it with the flux of this invention, coating it with molten metal by dipping it in a bath of the molten metal, and cooling it. The process is applicable not only to large structural steel parts or members, as for towers, bridges and buildings, but also to various other materials, such as castings or forgings, steel sheets for automobiles, and wires.

The pretreatment of the steel to be coated is carried out by dipping it for 30 to 60 minutes in an alkali solution containing sodium hydroxide and sodium orthosilicate in a weight ratio of 1:1, having a concentration of 10 to 15%, and kept at a temperature of 60° C. to 80° C., rinsing it with water, dipping it for 30 to 60 minutes in a 10 to 15% aqueous solution of sulfuric acid containing 0.5 to 0.7% of a pickling inhibitor, and kept at a temperature of 50° C. to 70° C. to remove scale and rust from it, and rinsing it with water, as is known in the art.

The flux treatment of the steel is carried out by dipping it for one or two minutes in a tank filled with the flux of this invention and heated to an appropriate temperature, which is at least 20° C., whereby a layer of the flux is formed on the surface of the steel. Although the flux solution can be used at ordinary temperature, it had better be heated to an appropriate temperature, so that a smaller amount of the flux solution may be carried over with the steel as treated, and so that a higher efficiency of treatment may be achieved.

After the liquid has been removed from the steel as treated with the flux, the step of coating it is carried out by dipping it for one to 10 minutes in a bath of molten metal, such as molten zinc, a molten alloy of zinc and aluminum, a molten alloy of zinc and aluminum further containing other elements, or molten aluminum, which is held at a temperature of 400° C. to 700° C., as is known in the art. This is a single-stage coating process. The dipping time depends on the overall size and shape of the material to be coated, and the thickness of the steel, but one to 10 minutes is preferable, since a longer time of dipping results in the undesirable promotion of an alloying reaction between iron, which is the principal constituent of steel, and zinc.

The melting points of zinc, aluminum and an alloy of zinc and aluminum are as shown by a phase diagram in FIG. 1, and hardly change, even if a small amount of other metal may be added. The temperature of the molten bath depends on the material, construction and heat capacity of the material to be coated, though it is usually at least 10° C. higher than the melting point of the metal or alloy forming the bath. After the passage of an appropriate dipping time, the steel as coated is lifted from the bath at an appropriate speed, so that the liquid metal or alloy may be removed from it.

Finally, the cooling of the coated steel is carried out by dipping it in water having a temperature of 30° C. to 50° C. for one or two minutes, or alternatively, by exposing it to air if it is a sheet, bar, or other material having a small heat capacity. As a result, a uniform and beautiful coating which is free from any bare spots, roughness, or lumpiness is formed on the steel surface.

Figure 2:
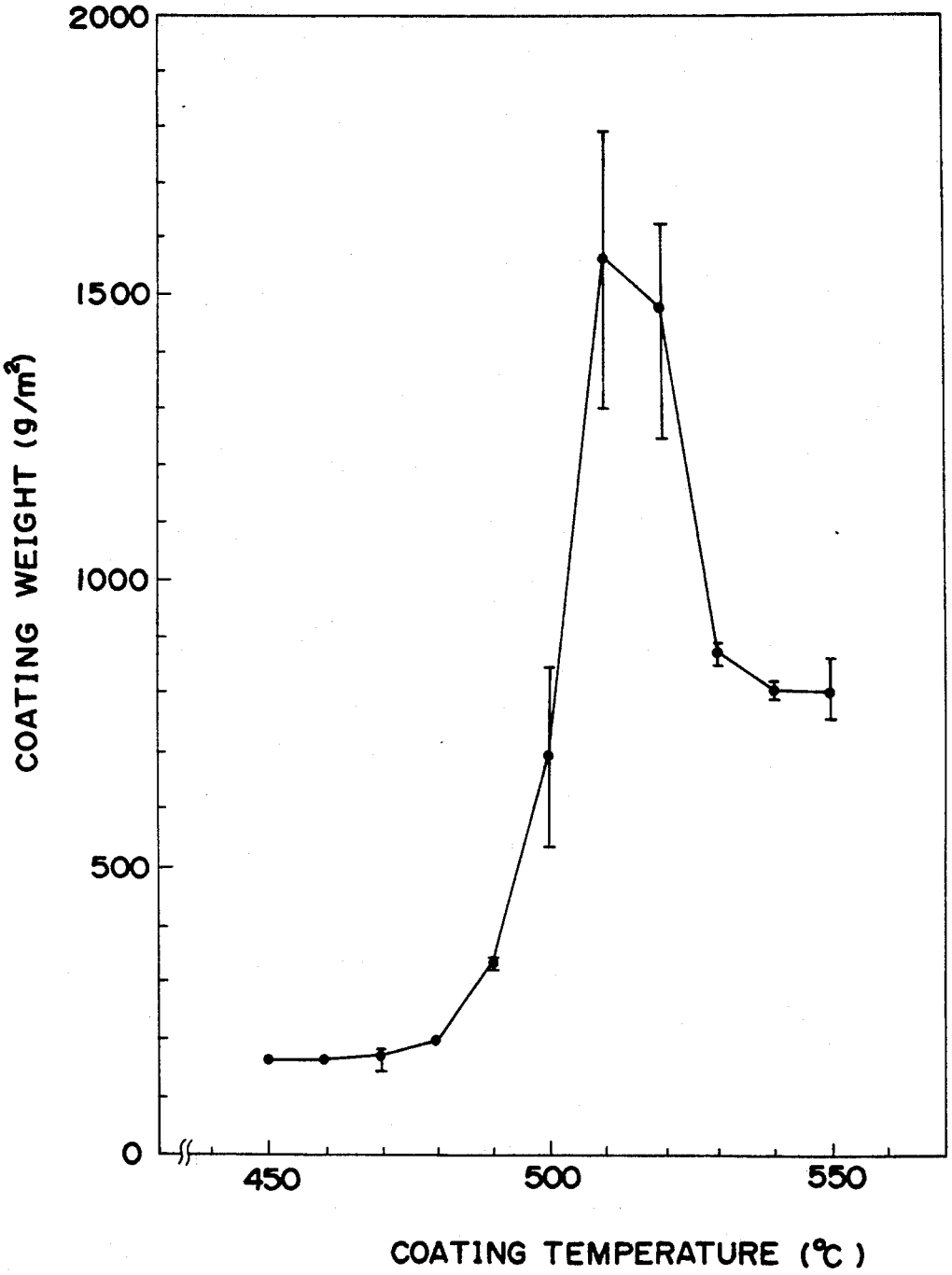
FIG. 2 is a graph showing a coating weight in relation to a coating temperature.

FIG. 2 is a graph showing the relation as found between the molten bath temperature and the coating weight when steel sheets each having a width of 75 mm, a length of 150 mm and a thickness of 4.2 mm and treated with the flux of this invention were coated by dipping for two minutes in a bath of a molten alloy of zinc and aluminum containing 5% of aluminum (5Al-Zn). The 5Al-Zn alloy has a melting point of about 380° C., as shown in FIG. 1. Therefore, it is theoretically possible to carry out dip coating if the molten bath has a temperature which is higher than 380° C., and lower than the transformation temperature of iron. The coating weight is, however, largely dependent on the molten bath temperature, as shown in FIG. 2, and is too small to be industrially acceptable if the temperature is too low. The temperature of 400° C. to 700° C. is, therefore, employed for the purpose of this invention. The coating weight reaches the maximum range when the temperature is in the range of about 500° C. to 530° C., as is obvious from FIG. 2. The molten bath temperature and the dipping time need, therefore, be controlled in accordance with the thickness of the coating to be formed on the steel to be coated.

The invention will now be described more specifically with reference to a few examples thereof and a few comparative examples.

EXAMPLE 1

A sheet of STK55 steel measuring 150 mm, 100 mm and 12 mm in thickness, which had been degreased, pickled, and rinsed with water, was dipped in a flux solution containing 40% by weight of $ZnCl_2$, 10% by weight of $CaCl_2$ and 1% by weight of trimethyllaurylammonium chloride and heated to 70° C. After one minute, it was lifted from the flux solution, and was immediately dipped in a bath of a molten alloy of zinc and aluminum containing 5% of aluminum and heated to 540° C. After one minute, it was lifted from the bath, and after it had been left in the air for one minute to cool, it was dipped in cooling water having a temperature of 50° C., whereby its cooling was completed.

A lustrous and smooth coating having a silver white color and free from any bare spots, or other defect could be formed on the surface of the sheet.

EXAMPLE 2

A cold rolled steel sheet measuring 200 mm, 100 mm and 2.3 mm in thickness, which had been degreased, pickled, and rinsed with water, was dipped in a flux solution containing 35% by weight of $ZnCl_2$, 5% by weight of NaCl and 1% by weight of dimethyldistearylammonium chloride and heated to 70° C. After one minute, it was lifted from the flux solution, and was immediately dipped in a bath of a molten alloy of zinc and aluminum containing 10% of aluminum and heated to 470° C. After one minute, it was lifted from the bath, and after it had been left in the air for one minute to cool, it was dipped in cooling water having a temperature of 50° C., whereby its cooling was completed.

A lustrous and smooth coating having a silver white color and free from any bare spots, or other defect could be formed on the surface of the sheet.

COMPARATIVE EXAMPLE 1

A sheet of STK55 steel measuring 150 mm, 100 mm and 12 mm in thickness, which had been degreased, pickled, and rinsed with water, was dipped in a flux solution containing 30% by weight of $ZnCl_2$ and 10% by weight of KCl and heated to 80° C. After one minute, it was lifted from the flux solution, and was immediately dipped in a bath of a molten alloy of zinc and aluminum containing 5% of aluminum and heated to 540° C. After one minute, it was lifted from the bath, and after it had been left in the air for one minute to cool, it was dipped in cooling water having a temperature of 50° C., whereby its cooling was completed.

There was obtained a coating having many bare spots and presenting a surface composed of a mixture of lustrous and unlustrous portions.

COMPARATIVE EXAMPLE 2

A cold rolled steel sheet measuring 200 mm, 100 mm and 2.3 mm in thickness, which had been degreased, pickled, and rinsed with water, was dipped in a flux solution containing 20% by weight of $ZnCl_2$ and 10% by weight of $NH_4Cl$ and heated to 80° C. After one minute, it was lifted from the flux solution, and was immediately dipped in a bath of a molten alloy of zinc and aluminum containing 5% of aluminum and heated to 470° C. After one minute, it was lifted from the bath, and after it had been left in the air for one minute to cool, it was dipped in cooling water having a temperature of 50° C., whereby its cooling was completed.

No lustrous and smooth coating could be formed. The greater part of the sheet surface remained uncoated, and those portions which had been coated with the alloy had rough surfaces.

The use of the flux according to this invention, essentially comprising at least one chloride selected from the group consisting of zinc chloride, stannous chloride, an alkali metal chloride and an alkaline earth metal chloride and at least one aliphatic nitrogen derivative with alkyl group having 1 to 18 carbons, enables a uniform coating giving high corrosion resistance to be formed on a steel surface from a molten alloy of zinc and aluminum by a single-stage dip-coating process without leaving any bare spots, though the single-stage process has hitherto been employed for hot dip galvanizing and considered difficult to employ for coating with a molten alloy of zinc and aluminum. Thus, the flux of this invention is effective for the treatment of, among others, the material to be coated with a molten alloy of zinc and aluminum.

The flux of this invention is also useful for the treatment of the material to be coated with molten aluminum, for which it has been usual to employ a wet process for treatment with a flux containing fluoride, etc. The flux of this invention is less likely to corrode the pot containing molten aluminum, as it consists mainly of chlorides. Moreover, the dry process improves the efficiency of the flux treatment.

The flux of this invention is, of course, useful for the treatment of the material to be coated with galvanizing, too. It does not undergo any substantial fuming when the material to be coated is dipped in a zinc bath, as it does not contain any ammonium chloride, unlike the conventional flux, and enables the formation of a good coating.

The aliphatic nitrogen derivative with alkyl group having 1 to 18 carbons which the flux contains bubbles on the surface of the steel to be coated when it is dipped in the molten bath. This bubbling results in the quick removal of the waste of the flux from the steel surface and the improved wetting of the steel surface with molten metal to thereby enable the formation of an improved coating adhering strongly to the steel surface. A particularly good result can be achieved when the derivative is an alkyl quaternary ammonium salt, or alkylamine which bubbles as a result of Hofmann decomposition.

A particularly good coating can be formed when the flux comprises 10 to 50% by weight of zinc chloride or stannous chloride, or both, 1 to 20% by weight of at least one alkali metal chloride or alkaline earth metal chloride, and 0.1 to 30% by weight of at least one alkyl quaternary ammonium salt, or alkylamine.

The dry process of this invention including treatment with the flux of this invention comprises the steps of pretreating the steel to be coated by dipping it in alkali bath to degrease it, rinsing it with water, and pickling it; treating the steel by dipping with a flux containing at least one chloride selected from the group consisting of zinc chloride, stannous chloride, an alkali metal chloride, and an alkaline earth metal chloride, and at least one aliphatic nitrogen derivative with alkyl group having 1 to 18 carbons; dipping said steel in a bath of molten metal to form a coating of said metal thereon; and cooling said steel by dipping it in water, or by allowing it to cool in the air. Therefore, this process enables the manufacture of steel coated with a molten alloy of zinc and aluminum, or molten aluminum by a single dipping operation which has hitherto been considered difficult. The process is, of course, useful for the manufacture of steels coated with other metals or alloys, too.

What is claimed is:

1. A flux for use in a dry process for the flux treatment of the material to be coated with molten metal, said flux comprising (i) at least one chloride selected from the group consisting of zinc chloride and stannous chloride, (ii) at least one compound selected from the group consisting of an alkali metal chloride and an alkaline earth metal chloride and (iii) at least one alkyl quaternary ammonium salt with alkyl group having 1 to 18 carbons.

2. A flux as set forth in claim 1, wherein said derivative is an alkyl quaternary ammonium salt with alkyl group having 7 to 18 carbons.

3. A flux as set forth in claim 1 or claim 2, wherein said flux comprising 10 to 50% by weight of at least one compound selected from the group consisting of zinc chloride and stannous chloride, and 0.1 to 30% by weight of said and an alkylamine.

4. A flux as set forth in claim 1 or claim 2, wherein said flux comprising 1 to 20% by weight of at least one compound selected from the group consisting of an alkali metal chloride and an alkaline earth metal chloride, and 0.1 to 30% by weight of said alkyl quaternary ammonium salt.

5. A flux as set forth in claim 1 or claim 2, wherein said flux comprising 10 to 50% by weight of at least one compound selected from the group consisting of zinc chloride and stannous chloride, 1 to 20% by weight of at least one compound selected from the group consisting of an alkali metal chloride and an alkaline earth metal chloride, and 0.1 to 30% by weight of said alkyl quaternary ammonium salt.

6. A flux as set forth in claim 5, wherein said ammonium salt is selected from the group consisting of alkyltrimethylammonium chloride and dialkyldimethylammonium chloride.

7. A process for manufacturing steel coated with molten metal comprising the steps of:

pretreating the steel to be coated by dipping it in an alkali bath to degrease it, rinsing it with water, and pickling it;

treating said steel by dipping it in a flux containing (i) at least one chloride selected from the group consisting of zinc chloride and stannous chloride, (ii) at least one compound selected from the group consisting of an alkali metal chloride and an alkaline earth metal chloride, and (iii) at least one alkyl quaternary ammonium salt with alkyl group having 1 to 18 carbons;

dipping said steel in a bath of molten metal to form a coating of said metal thereon; and cooling said steel by dipping it in water, or by allowing it to cool in the air.

8. A process as set forth in claim 7, wherein said derivative is an alkyl quaternary ammonium salt with alkyl group having 7 to 18 carbons.

9. A process as set forth in claim 8, wherein said alkyl quaternary ammonium salt is selected from the group consisting of alkyltrimethylammonium chloride and dialkyldimethylammonium chloride.

10. A process as set forth in claim 7, wherein said molten metal is selected from the group consisting of molten zinc, a molten alloy of zinc and aluminum, a molten alloy of zinc and aluminum further containing other elements, and molten aluminum.

* * * * *

UNITED STATES PATENT AND TRADEMARK OFFICE
CERTIFICATE OF CORRECTION

PATENT NO.: 5,292,377
DATED : March 8, 1994
INVENTOR(S): IZEKI et al.

It is certified that error appears in the above-identified patent and that said Letters Patent is hereby corrected as shown below:

Column 8, line 22, delete "and an alkylamine." and substitute therefor --alkyl quaternary ammonium salt.--.

Signed and Sealed this

Twenty-eight Day of February, 1995

Bruce Lehman

*Attest:*

BRUCE LEHMAN

*Attesting Officer*

*Commissioner of Patents and Trademarks*